United States Patent [19]

Hirata

[11] 4,063,054

[45] Dec. 13, 1977

[54] KEY SWITCH

[75] Inventor: Osamu Hirata, Tokyo, Japan

[73] Assignee: Canon Kabushiki Kaisha, Tokyo, Japan

[21] Appl. No.: 632,105

[22] Filed: Nov. 14, 1975

[30] Foreign Application Priority Data

Nov. 22, 1974 Japan ..... 49-134924
Nov. 22, 1974 Japan ..... 49-134925

[51] Int. Cl.[2] ..... H01H 9/20

[52] U.S. Cl. ..... 200/159 R; 200/16 A; 200/275

[58] Field of Search ..... 200/159 R, 16 D, 16 C, 200/16 A, 16 B, 159 A, 159 B, 1 B, 16 R, 275

[56] References Cited

U.S. PATENT DOCUMENTS

| | | | |
|---|---|---|---|
| 3,448,226 | 6/1969 | Mading et al. | 200/16 A |
| 3,688,066 | 8/1972 | Adelson et al. | 200/159 R |
| 3,870,840 | 3/1975 | Rivetta et al. | 200/159 A |
| 3,909,564 | 9/1975 | Scheingold et al. | 200/159 B |
| 3,969,595 | 7/1976 | Johnson | 200/159 B |

*Primary Examiner*—Herman Hohauser
*Attorney, Agent, or Firm*—Fitzpatrick, Cella, Harper & Scinto

[57] ABSTRACT

A key switch provided with plural elastic elements to be actuated in succession in response to the operation of key top by finger and composed to perform opening or closing operation when at least two of said elastic elements are actuated thereby reducing bouncing or chattering.

4 Claims, 17 Drawing Figures

FIG. 1 (II)

FIG. 1 (III)

FIG. 1 (IV)

KEY SWITCH

BACKGROUND OF THE INVENTION

1. Field of the Invention

The present invention relates to a key switch, and particularly to a key switch capable of reducing chattering or bouncing.

2. Description of the Prior Art

Key switches of various structures have been employed for input switches for numbers and instructions of for example table-top electronic calculators, among which mechanically structured key switches have been predominant due to the low cost and simple structure thereof. Such mechanical key switches are equipped with a contact piece provided with contact points to cooperate with an electric circuit to be closed, said contact piece being pressed down by a key top actuated by an external force thereby closing said electric circuit, but is associated with the drawback of causing bouncing or chattering upon the operation thereof, which causes unnecessary closing of the electric circuit and results in erroneous operation of the calculator. Although various improvements have been proposed to the structure of key switches, such improvements have not been satisfactory in respect of durability, operational performance or time-dependent stability.

SUMMARY OF THE INVENTION

The principal object of the present invention is to provide a key switch capable of eliminating the above-mentioned drawback.

Another object of the present invention is to provide a key switch of a simple structure.

Other objects of the present invention will be made clear from the following explanation of the embodiments of the present invention.

DESCRIPTION OF THE PREFERRED EMBODIMENTS

There follows an explanation of an embodiment of the key switch of the present invention with particular reference to the attached drawings.

Figure 1:
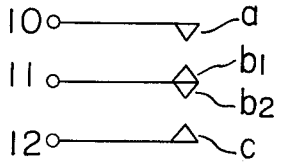
FIG. 1 is a conceptional drawing showing an embodiment of the key switch of the present invention.
Figure 1:
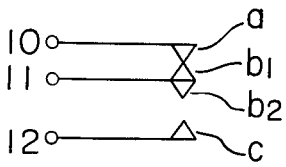
Figure 1:
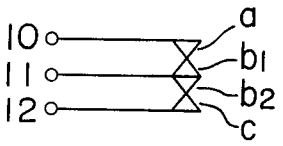
Figure 1:
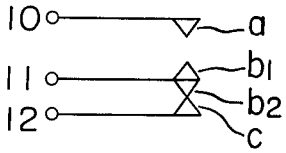

FIG. 1 is a conceptional drawing showing an embodiment of the key switch of the present invention, in which (I) indicates a situation in which the key switch is not operated. The key is provided with a terminal 10 to which a logic level L (positive logic) is applied, a terminal 11 to which for example logic levels L and H are repetitively supplied, and an output terminal 12 by which the signal from said terminal 11 is taken out. Said terminals 10, 11 and 12 are respectively provided with electrically connected contacts *a*, *b*1, *b*2 and *c*.

Said contacts *a*, *b*1, *b*2 and *c* arranged as explained above, function in the following manner. Upon pressing down of the key top (not indicated) by *a* small amount, the contact a comes into contact with said contact *b*1 connected with said terminal 11 as shown in (II) by means of an external force applied through said key top thereby maintaining the logical amplitude of the contact *b*1 at the L level. The contact *b*2 is naturally maintained at the same level as the contact *b*1. Further pressing down of the key top causes the contact *b*2 connected to the terminal 11, to come into contact with the contact *c* connected to the terminal 12, while said contacts *a* and *b*1 are maintained in contact, as shown in (III). In this state the signal applied to the terminal 11 is not taken out from the terminal 12 as the contact *a* is still in contact with the contact *b*1. Still further pressing down of the key top causes the contact *a* to be electrically separated from the contact *b*1 by means (not shown) thereby enabling transmission of the signal applied to the terminal 11 to pass through the contacts *b*2 and *c* to the terminal 12, thus representing the closed state of key switch, as shown in (IV). The key switch of the present invention is thus capable of reducing bouncing by the impact of contact as the transmission of signal is realized by opening a closed contact. Further, according to the present invention the state (I) may be omitted if the terminal 10 need not be commonly connected for all the key switches employed or if only one key switch is to be used.

Figure 2:
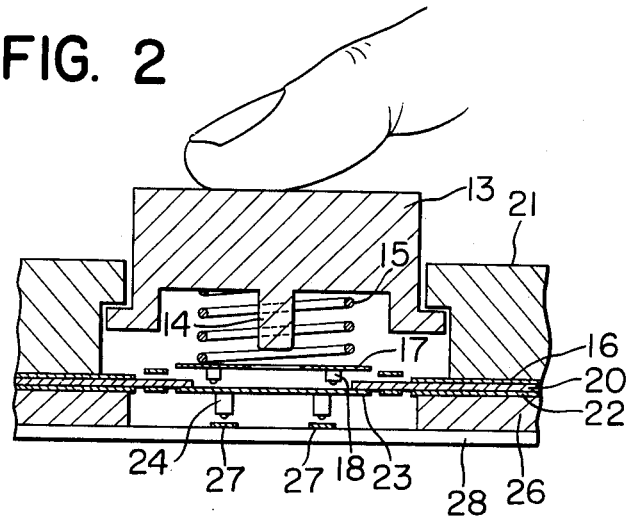
FIG. 2 is a lateral cross sectional view of an embodiment of the key switch shown in FIG. 1.
Figure 3A:
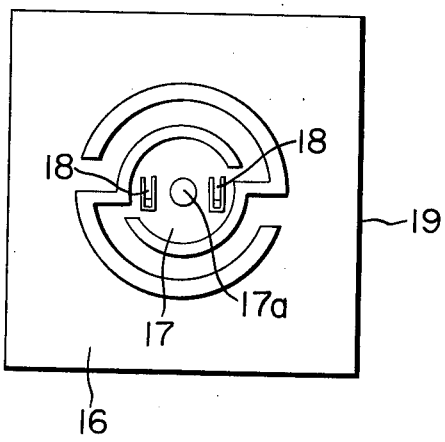
FIGS. 3(a) and 3(b) are plan views of first and second plate springs shown in FIG. 2.
Figure 3B:
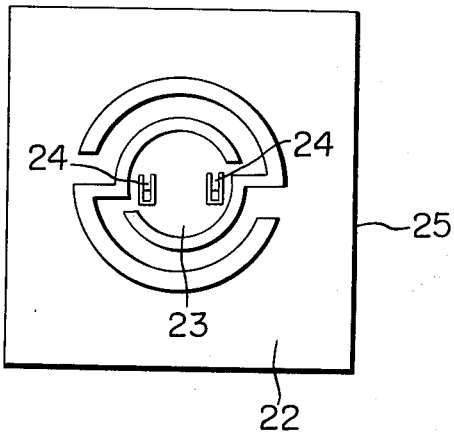

Referring to FIG. 2 showing a lateral cross section of an embodiment of the key switch of the present invention shown in FIG. 1, 13 indicates a key top which is to receive an external force by means for example of a finger, and which is provided with a downwardly extending protruding part 14 on the bottom thereof. Said bottom of key top 13 engages with an elastic element, for example a coil spring 15, which is provided to surround said protruding portion 14 and of which the other extremity is placed on the central portion 17 of a first plate spring member 16 of a conductive material and of a form shown in FIG. 3(a) with the central portion thereof protruding upwards. Said first plate spring member 16 is provided in the central portion 17 thereof with downwardly folded contact reeds 18 in turn provided with contacts *a* (FIG. 1). The peripheral portion 19 of said first plate spring member 16 is placed on an insulating spacer 20, and the upper side of said peripheral portion 19 is fixed by a key guide piece 21 defining the stroke of said key top 13. Under said spacer 20 there is provided a second plate spring member 22 of a form shown in FIG. 3(b) of which central portion 23 is provided with downwardly folded contact reeds 24 in turn provided with contacts *b2* (FIG. 1) and of which peripheral portion 25 is sandwiched between the spacers 20 and 26, and a conductive element 27 connected with the electric circuit is provided on a support plate 28 for closing said electric circuit with said contact *b2*.

Figure 4A:
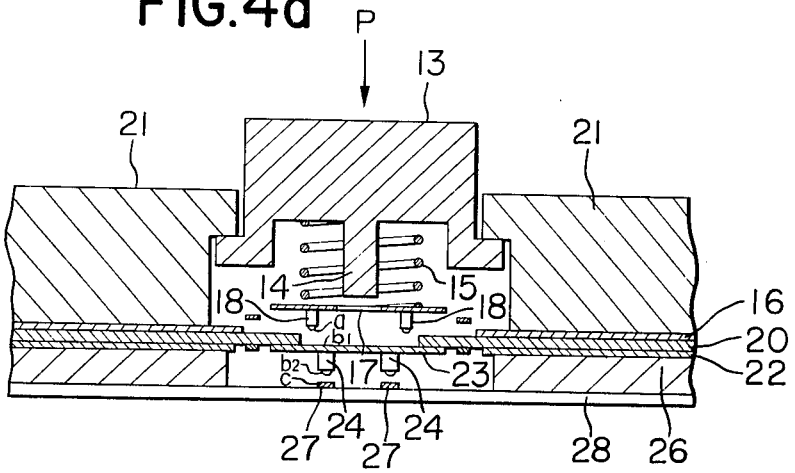
FIGS. 4(a) to 4(d) show various conditions of the key switch wherein (a) is a situation without external force, (b) is a situation with a certain external force, (c) is a situation with an increased external force, (d) is a situation with a still increased external force.
Figure 4B:
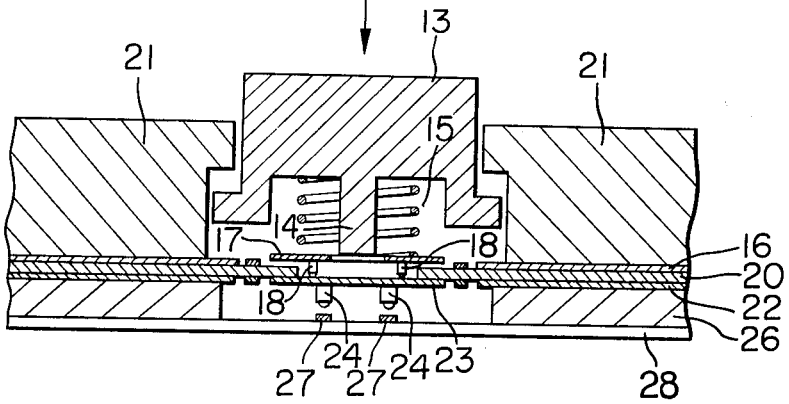
Figure 4C:
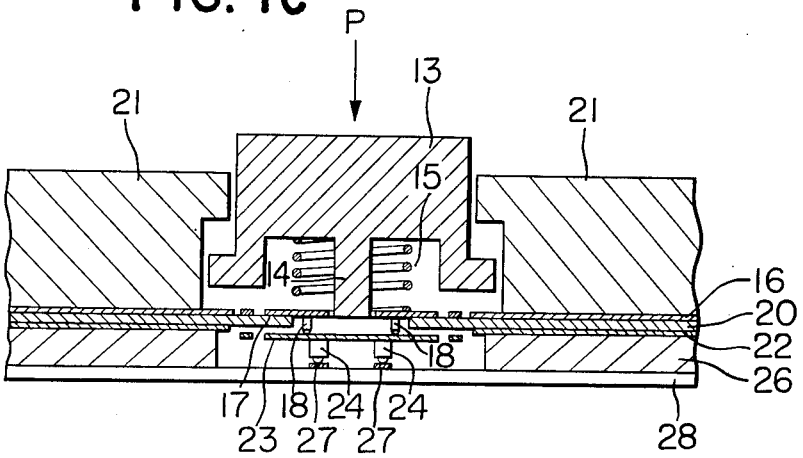
Figure 4D:
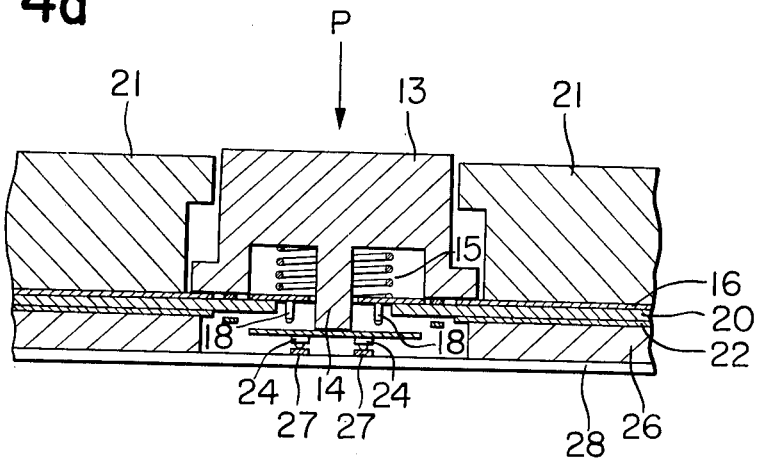
Figure 5:
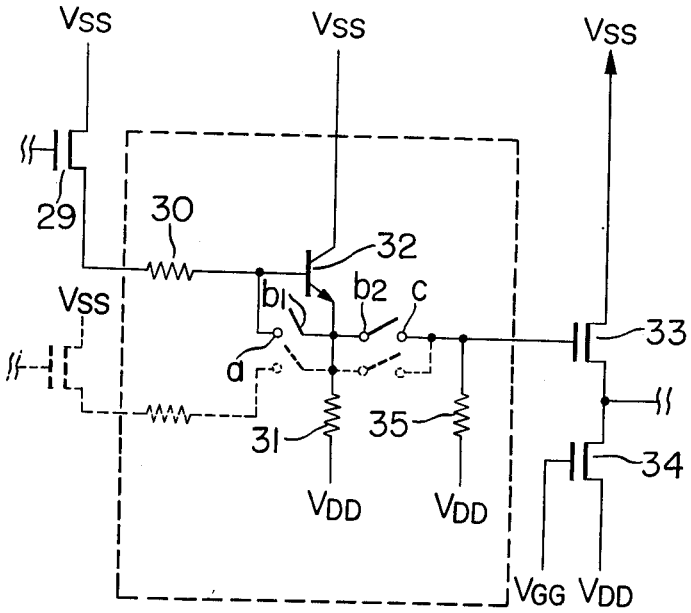
FIG. 5 is a circuit diagram showing an example showing an example of the use of the key switch shown in FIG. 1.

The function of the structured embodiment will be explained in the following with reference to FIG. 4 showing the various conditions of the key switch, and to FIG. 5 showing an example of a key circuit incorporating such key switch.

In the absence of the external force, the contacts *a* and *b1*, and the contacts *b2* and *c* are maintained in an electrically open state (the contact *b1* is composed of said central portion 23 which is united with the contact *b2*), as shown in FIG. 4(a). Upon application of an external force on the key top 13, said key top 13 starts to descend along said key guide 21, as shown in FIG. 4(b), to compress said coil spring 15 the other extremity of which engages the central portion 17 of the first plate spring member 16 which is in turn pressed to cause said contact *a* provided on said contact reeds 18 to come into contact with the central portion 23 of second plate spring member 22. Referring to FIG. 5, the signal obtained from the drain of a MOS transistor 29 generating intermittent pulses is supplied, through said contacts *a* and *b1* and through resistors 30 and 31 to the power source VDD, and the emitter of a transistor 32 assumes a potential divided by said resistors 30 and 31.

Upon the application of an increased external force on the key top 13, the central portion 17 of first plate spring member 16 descends, as pressed by the force on said key top transmitted by said coil spring 15, as far as permitted by said spacer 20, and simultaneously depresses, through said contact reeds 18 of the first plate spring member, the central portion 23 of second plate spring member 22 to cause the contact *b2* of said contact reeds 24 to come into contact with said conductive element 27, as shown in FIG. 4(c). Thus the contacts *b2* and *c* are closed while the contacts *a* and *b1* are maintained closed, and in this manner the emitter potential of transistor 32 is transmitted to the gate of MOS transistor 33. However the source of load MOS transistor 34 for obtaining an output signal remains unchanged as said transistor 33 does not reach the 'on' level. The resistor 35 is provided to maintain said MOS transistor in 'off' state when the contacts *b1* and *c* are open.

Upon application of a further increased force P on the key top 13, said protruding portion 14 thereof enters an opening 17*a* provided in the central portion 17 of first plate spring member 16 as shown in FIG. 4(d), to depress the central portion 23 of second plate spring member 22 thereby disconnecting the electric contact between *a* and *b1* (central portion 14) while retaining said contact *b2* on the contact reeds 24 in contact with the contact *c* of conductive element 27. In this manner the contacts *a* and *b1* are opened while the contact *b2* and *c* are maintained closed, and the transistor 32 thus functions as an emitter follower. Consequently, the value of resistor 31, viewed from the base of transistor 22, becomes larger than the resistance 30, and an H level signal applied to the base of transistor 32 appears on the emitter thereof to switch on the MOS transistor 33 thereby turning the drain thereof to H level. Said drain provides an L level VDD when an H level signal is not supplied to the gate of MOS transistor 33. Thus the signal is transmitted, by means of transistor 32, at a lower output impedance to the MOS transistor 33. The key switch of the present invention can be easily adaptable to prior key input circuits.

The dotted line in FIG. 5 indicates the arrangement in case plural key switches are to be employed.

Figure 6:
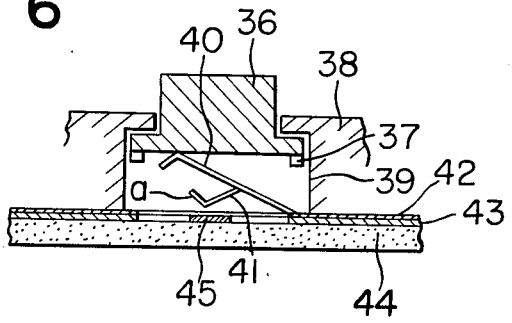
FIG. 6 is a lateral cross sectional view showing another embodiment of the key switch of the present invention.
Figure 7:
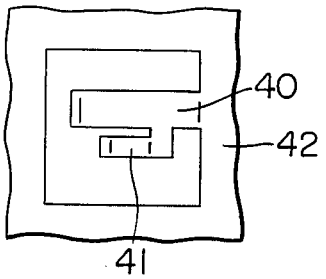
FIG. 7 is a plan view of the conductive elastic plate shown in FIG. 6.

FIG. 6 shows another embodiment of the key switch of the present invention wherein 36 indicates a key top provided on the bottom thereof with a downwardly extending stopper 37, said key top being displaceable along a key guide 39 provided in an upper cover 38, upon application of an external force thereon. 40 is a conductive elastic plate spring provided under said key top with one end thereof engaging with the bottom of said key top while the other end thereof is fixed as explained later, in order to return, upon elimination of said external force, the key top to the original position thereof as shown in FIG. 6. 41 is a contact reed with a contact *a* provided substantially parallel to said plate spring 40 as shown in plan view FIG. 7 and fixed to said plate spring 40 at one extremity thereof.

The contact reed 41 extends, in lateral view, downwardly so as to cross the direction of said plate spring 40. Said plate spring 40 and contact reed 41 are formed from a thin elastic plate as shown in FIG. 7 and are connected, at the fixed extremity of plate spring 40, with the peripheral portion 42 which is fixed, together with a spacer 43, between said upper cover 38 and base plate 44 provided with an electric circuit to be closed by said contact *a* of contact reed 41.

Figure 8:
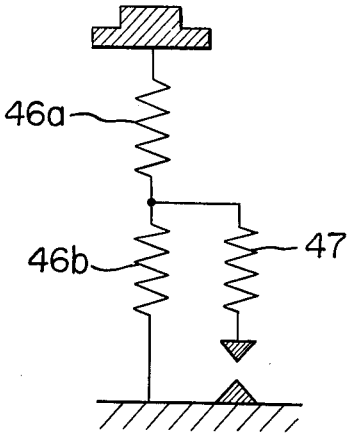
FIG. 8 is an explanatory drawing showing the operation of key switch shown in FIG. 6.

The function of this structural embodiment will be explained in the following with reference to FIGS. 6 and 8.

Upon application of an external force to press down the key top, the descent thereof causes the descent of free end of said plate spring 40, and the repulsive force thereof is simultaneously transmitted through said key top to the finger etc. Further pressing down of the key top causes, due to corresponding descent of plate spring 40, the contact *a* of contact reed 41 to come into contact with said electric circuit 45 to close said circuit. Upon contact of *a* with electric circuit 45, the repulsive force applied to the key top 36 is further increased due to the spring force 47 by contact reed 41 in addition to the spring forces 46*a* and 46*b* by the spring 40. Such increased repulsive force retards the descent of key top 36, and the impact between the contact and electric circuit 45 is reduced since the contacts are made through springs, thereby reducing chattering. Also the contact reeds function as springs for absorbing the impact.

Such contact reed 41, if made with sufficiently narrow width, does not unnecessarily increase the spring constant and is thus capable of reducing bouncing.

Figure 9:
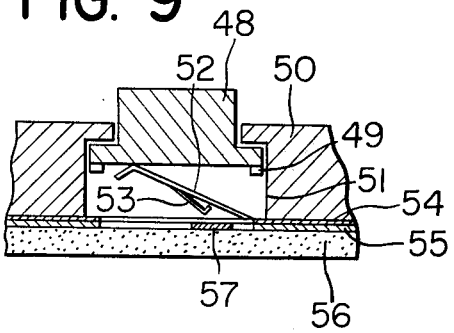
FIG. 9 is a lateral cross sectional view of still another embodiment of the key switch of the present invention.
Figure 10:
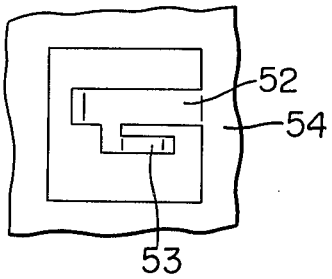
FIG. 10 is a plan view of the elastic plate in the key switch shown in FIG. 9.

FIG. 9 shows lateral cross section of a still another embodiment of the key switch of the present invention, wherein 48 is a key top provided at the bottom thereof with a downwardly extending stopper 49, said key top being displaceable upon application of an external force thereon along a key guide 51 provided in an upper cover 50. 52 is a conductive elastic plate spring provided under said key top 48 to engage with the bottom of said key top 48 at a free end thereof, and to be fixed at the other end thereof as explained later, to return said key top 48 upon elimination of said external force thereon, to the original position shown in FIG. 9. 53 is a contact reed with a contact *b* provided substantially parallel, in plan view shown in FIG. 10, to the direction of said plate spring 52 and is fixed at an end thereof to a side of said plate spring 52.

Further, said contact reed 53 is fixed close to the free end of said plate spring 52 and extends toward the fixed end thereof. Said plate spring 52 and contact reed 53 are made from a thin conductive elastic plate as shown in FIG. 10 and is connected, at the fixed end of said plate spring 52, to a peripheral portion 54, which is fixed together with a spacer 55 between said upper cover 50 and a base plate 56 provided thereon with an electric circuit 57 to be closed upon contact with the contact *b* of contact reed 53.

Figure 11:
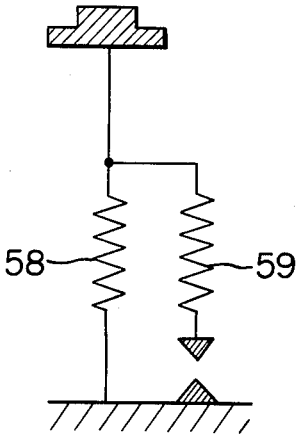
FIG. 11 is an explanatory drawing showing the operation of key switch shown in FIG. 9.

The function of this structural embodiment will be explained in the following with reference to FIG. 9 and FIG. 11.

Upon application of an external force by means for example of a finger to press down the key top 48, the resulting descent thereof causes the spring force 58 by said spring 52 to apply a repulsive force on the key top 48 and to reduce the angle of plate spring 52 with respect to the base plate 56 thereby causing the contact reed 53 fixed on a side of said plate spring 52 to approach the electric contact 57 provided on said base plate 52. Upon application of further external force on the key top 48, the contact reed 53 comes into contact with the contact *b* thereof with said electric circuit 57 to function as a spring 59 as shown in FIG. 11 thereby absorbing the impact of contact and reducing bouncing etc.

Figure 12:
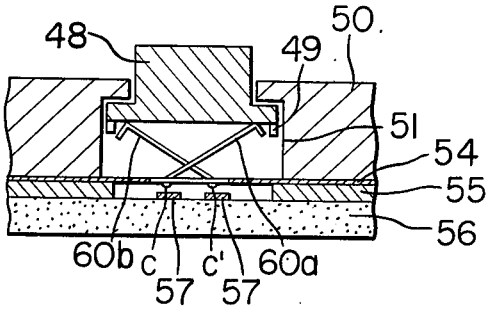
FIG. 12 is a lateral cross sectional view of still another embodiment of the key switch of the present invention.

FIG. 12 shows a lateral cross section of a still another embodiment of the key switch of the present invention wherein the components common with the preceding embodiments are represented by the same members.

Figure 13:
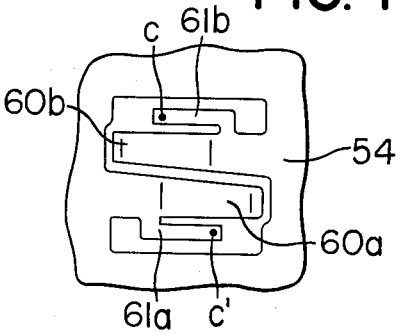
FIG. 13 is a plan view of the elastic plate shown in FIG. 12.

In this embodiment plate springs 60*a* and 60*b* extend from the opposing sides of a peripheral portion 54 made from a conductive elastic plate as shown in FIG. 13, and contact reeds 61*a* and 61*b* are branched from said plate springs 60*a* and 60*b* so as to extend in the same direction thereto, said reeds 61*a* and 61*b* being respectively provided with downwardly protruding spherical contacts *c* and *c'*.

Said peripheral portion 54 is fixed between an upper plate 50 and a spacer 55, and said plate springs 60*a* and 60*b* are folded upward at the connecting part with said contact reeds 61*a* and 61*b* so as to support a key top 48 thereon while said reeds 61*a* and 61*b* are arranged substantially coplanar with said peripheral portion 54.

The function of this structural embodiment will be explained in the following with reference to FIG. 13.

Upon application of an external force on the key top 48, the descent thereof along a key guide 51 reduces the angle of said plate springs 50*a* and 50*b* with respect to the base plate 56. Further pressing down of the key top 48 causes said contact reeds 61*a* and 61*b* to rotate around the junction between said plate springs 60*a* and 60*b* and said peripheral portion 54 thereby bringing said contacts *c, c'* on said reeds 61*a*, 61*b* into contact with an electric circuit 57 provided on said base plate 56. The contact reeds 61*a*, 61*b* are thus provided with an approaching speed to said electric contact 57 smaller than the descending speed of said key top 48, thus reducing the impact of collision and avoiding bouncing etc. Further it is possible to significantly reduce the bending parts of the contact reeds and also to reduce the rotational speed thereof.

In the above-mentioned embodiments it is possible to regulate the speed ratio of plate springs and the stress therein by making said plate springs in a trapezoidal form. Further similar effect can be obtained also in other forms of plate springs. Further the key switch of the present invention is particularly adapted for producing plural key switches in a collective form.

What is claimed is:

1. A key switch comprising:

a key top movable in response to an external force applied thereto;

a first plate spring for supporting said key top and responding to the movement thereof;

a first switch circuit operable by said first plate spring;

a second plate spring actuated in response to said first plate spring;

a second switch circuit operable by said second plate spring; and a means operable in response to the movement of said key top to close said second switch circuit and to open said first switch circuit.

2. A key switch according to the claim 1 wherein said first and second plate springs are composed of conductive metal plates.

3. A key switch comprising:

a key top movable in response to an external force applied thereto;

an element extending downward from said key top;

means cooperating with the bottom of said key top to transmit the movement thereof;

a first conductive plate spring responding to the movement of said key top through said transmitting means;

a first switch means operable by said first plate spring and adapted to be opened by said extending element;

a second conductive plate spring responding to the movement of said first plate spring and also to the movement of said extending element; and a second switch means operable by said second plate spring.

4. A key switch comprising:

a key top movable in response to an external force applied thereto;

a first switch means to close a circuit in response to the movement of said key top;

a second switch means to close a circuit in response to the movement of said key top;

a means for opening said first switch circuit while retaining said second switch circuit in closed state in response to the movement of said key top after said first switch circuit is closed.

* * * * *